US005359966A

United States Patent [19]

Jensen

[11] Patent Number: 5,359,966

[45] Date of Patent: Nov. 1, 1994

[54] ENERGY CONVERTER USING IMPLODING PLASMA VORTEX HEATING

[76] Inventor: Donald C. Jensen, 138 Alhambra Pl., West Palm Beach, Fla. 33405

[21] Appl. No.: 896,610

[22] Filed: Jun. 10, 1992

[51] Int. Cl.[5] ..... F22B 5/00

[52] U.S. Cl. ..... 122/14; 122/19; 122/33; 431/9; 431/173; 431/208; 431/215

[58] Field of Search ..... 110/264; 431/173, 9, 431/116, 207, 208, 215, 242, 243, 247, 248, 115; 122/10, 13.1, 19, 14, 33

[56] References Cited

U.S. PATENT DOCUMENTS

| | | | |
|---|---|---|---|
| 2,747,526 | 5/1956 | Seidl | 110/28 |
| 3,597,141 | 8/1971 | Frache et al. | 431/173 |
| 4,255,116 | 3/1981 | Zwick | 431/247 X |
| 4,297,093 | 10/1981 | Morimoto et al. | 431/10 |
| 4,364,724 | 12/1982 | Alpkvist | 431/247 X |
| 4,758,153 | 7/1988 | Forster | 431/208 |

*Primary Examiner*—Edward G. Favors
*Attorney, Agent, or Firm*—Oltman and Flynn

[57] ABSTRACT

A heating system for heating a heat sink via a heat transfer medium. The invention includes a vortex chamber having opposite first and second inwardly curved end walls, a combustion chamber fluidly communicating with the vortex chamber, fuel-air supply means fluidly communicating with the combustion chamber for injecting fuel-air mixture into the combustion chamber. Ignition means are provided in the combustion chamber for igniting the fuel-air mixture. A fuel ionizing chamber is disposed in the vortex chamber fluidly communicating with the fuel-air supply means for ionizing fuel entering the fuel-air supply means, and heat transfer medium containing means are provided for holding the heat transfer medium in thermal contact with the vortex chamber.

33 Claims, 8 Drawing Sheets

ENERGY CONVERTER USING IMPLODING PLASMA VORTEX HEATING

BACKGROUND AND PRIOR ART

The invention relates to a method and apparatus for converting energy through combustion of fuel by means of so-called sustained imploding vortex technology in the form of a super-heated, high velocity rotating gas mass. It was discovered by applicant that when such a system is properly understood and utilized it provides a unique method of maximizing the conversion efficiency of energy from various fuels in forms of gas, liquid, powders and even in solid form. According to the invention the fuel is preheated to very high temperature so as to make it chemically and molecularly highly active to enclose the preheated fuel so that it forms an insulated ionizing energy ball, containing large numbers of free electrons. From observation on actual prototype tests, the electrons are believed to attach themselves to the activated fuel molecules, causing the fuel to behave as an ionized plasma within a combustion chamber. The plasma form of the gas greatly increases the combustion efficiency which further increases the temperature of the plasma. Diesel oil that normally burns at 1200° F. in conventional systems has been measured at a combustion temperature in excess of 2400° F. in a representative prototype of the invention. The flow patterns within the plasma vortex are of significant importance in the operation of the system in that they create and sustain an implosion within the combustion chamber and a heat collection chamber connected thereto. It is accordingly a primary object of the invention to maximize thermal combustion efficiency by means of imploding vortex technology.

The sustained imploding vortex mentioned above is defined as a system of stratified gas plasma wherein the heavier particles of the gas masses become progressively stratified in parallel with the outer perimeter of the vortex and the lighter particles of the gas masses become progressively stratified around the central core of the vortex. Rotating vortices of gas plasma form a gravitational gradient causing the heavier gas particles to drift to the outer perimeter and the lighter particles to the central core. It is also demonstrable that the temperature of the center of the vortex is relatively cool when compared with the temperature at its periphery. The invention utilizes all of the characteristics of the imploding vortex technology to its advantage so as to increase the combustion efficiency and to greatly reduce and/or eliminate polluting emissions commonly associated with combustion of hydrocarbon and other fuels.

The invention as disclosed can be used for heating an industrial boiler, a domestic or commercial hot water heater, or any heating system using liquid or air or other gas as a heat transfer medium. The system is also in a further development capable of generating electrical current by the known principles of Magneto Hydrodynamics.

Inventors have in the past disclosed heating systems based on the principle of forming a vortex of burning gases. As examples, U.S. Pat. No. 2,747,526 shows a cyclone furnace wherein a granular solid fuel is directed in a high velocity stream of superatmospheric pressure carrier air directed tangentially into a fluid-cooled cyclone chamber. U.S. Pat. No. 3,597,141 discloses a burner for gaseous, liquid pulverized fuel, which has a tubular burner structure of a rotationally symmetrical shape, and which has nozzles for supplying combustion air tangentially into the combustion chamber. U.S. Pat. No. 4,297,093 discloses a combustion method which can reduce the emission of NOx and smoke by means of a specific flow pattern of fuel and combustion air in the combustion chamber, and wherein secondary air is injected to create a swirling air flow.

None of the prior art, however, shows the use of applicant's concept of the so-called Imploding Plasma Vortex, wherein a vortex of burning gases is configured such that a vortex of burning gas plasma is sustained in a combustion chamber such that the vortex is "folded back" into itself, creating a double helix of burning gases at very high temperatures combined with preheating of the fuel and combustion air.

The principle of the imploding plasma vortex leads to a combustion process of very high thermal conversion efficiency and to a very complete combustion that minimizes polluting emissions.

SUMMARY OF THE INVENTION

The invention is based on the principle of imploding plasma dynamics ("I.P.D.") wherein sustained implosion is maintained in the form of a super-heated, high velocity imploding vortex in a suitably shaped combustion chamber which leads to creation of plasma combustion super-heating and ionizing of the fuel within an ionizing chamber inside a vortex chamber prior to combustion. The system is constructed to maximize laminar flow in the vortex so as to stratify molecular and atomic articles by particle mass. The resulting flow pattern operates to drive the heavier particles into the very hot peripheral pressure strata where they release their kinetic energy before they return as lighter gases to the low pressure at the central core of the vortex, causing a repetition of the cycle. It is recognized that a sustained imploding plasma combustion produces great quantities of free electrons within the plasma so as to produce strata of very high and very low pressures and temperatures, and stratification by mass and polarization by orbit, and great variation of electrical potentials. The inventive concept also includes electrically insulating the combustion and ionizing fuel chamber in such a way as to use these chambers as electrodes so as to supply an electric current by the principle of magneto-hydrodynamics.

In accordance with the invention there is provided a heating system for heating a heat sink via a heat transfer medium. The invention includes a vortex chamber having opposite first and second inwardly curved end walls, a combustion chamber fluidly communication with the vortex chamber, fuel-air supply means fluidly communicating with the combustion chamber for injecting fuel-air mixture into the combustion chamber. Ignition means are provided in the combustion chamber for igniting the fuel-air mixture. A fuel ionizing chamber is disposed in the vortex chamber fluidly communicating with the fuel-air supply means for ionizing fuel entering the fuel-air supply means, and heat transfer medium containing means are provided for holding the heat transfer medium in thermal contact with the vortex chamber.

In accordance with a further feature the heating system includes an air preheat space enclosing the combustion chamber, at least one air tube having an air outlet tangentially engaging the air preheat space and an air inlet, and an air blower connected to the air inlet for injecting air into the air preheat space for generating a vortex of preheated air in the air preheat space.

According to a further feature there is provided a fuel dispersion unit in the combustion chamber, fluidly communicating with the fuel ionizing chamber for dispersing fuel into the combustion chamber.

According to still another feature, the heating system includes in the fuel-air supply means a fuel vaporizer having a fuel inlet fluidly communicating with the fuel source, and a fuel outlet fluidly communicating with the fuel ionizing chamber, further including fuel dispersing means in the fuel ionizing chamber, a fuel baffle in the fuel dispersing means, a pedestal supporting the baffle in the fuel ionizing chamber, and at least one weeping hole in the pedestal for releasing fuel accumulating in the fuel ionizing chamber.

The heating system according to the invention includes electric insulating means for electrically insulating the fuel-ionizing chamber from the vortex chamber, and a plurality of apertures in the fuel dispersion unit for passing ionized fuel into the combustion chamber.

An exhaust tube fluidly communicating with the vortex chamber is provided for exhausting burnt fuel air mixture, and a fuel tube disposed coaxially within the exhaust tube in fluid communication with the fuel vaporizer.

The electric insulating means include a first circular electric insulator in the fuel tube for electrically insulating the fuel ionizing chamber from the fuel vaporizer, a tubular connection between the fuel ionizing chamber and the fuel dispersion unit, and a one way check valve can be inserted in the tubular connection for preventing oxygen from accidentally entering the ionizing chamber from the combustion chamber and possibly causing ignition in the fuel ionizing chamber via the fuel dispersion unit.

The invention further includes a heat sink in fluid communication with the heat transfer containing means, and wherein the heat transfer medium is a liquid or gaseous fluid, and further a plurality of heat transfer chambers in the heat transfer medium containing means, each of the heat transfer chambers containing a respective heat transfer medium in fluid communication with a respective heat sink.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DESCRIPTION OF THE PREFERRED EMBODIMENTS

Figure 1:
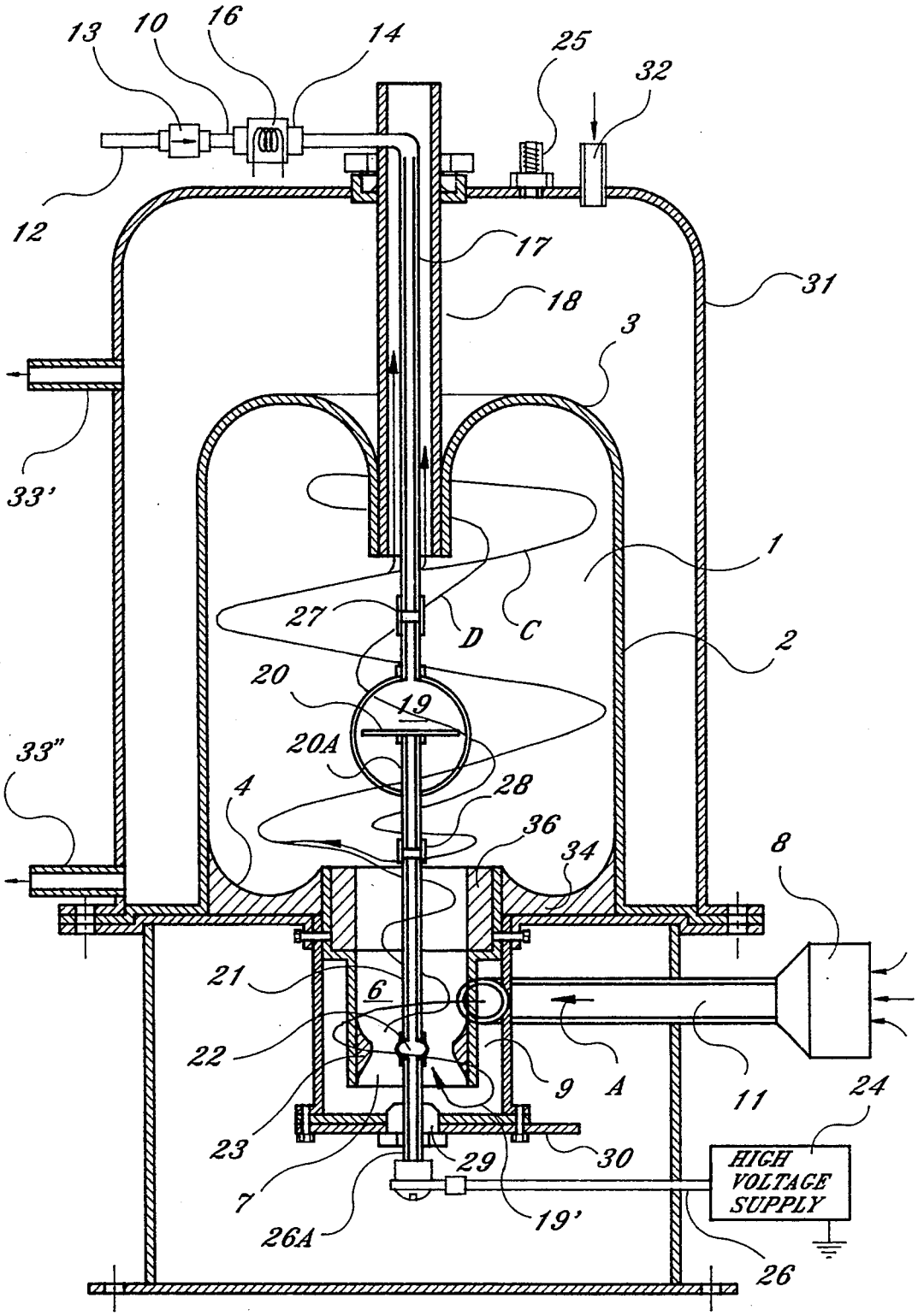
FIG. 1 is an elevational diagrammatic cross-sectional view of the invention showing its basic elements.

In FIG. 1 a vortex chamber 1 has a substantially cylindrical wall 2, enclosed by first and second inwardly curved end walls 3 and 4. A combustion chamber 6 is fluidly communicating through second end wall 4 with the vortex chamber 1, and has an air inlet 7 receiving air from an air compressor 8 via an air inlet tube 11 and a circular air space 9 surrounding the combustion chamber 6 which serves to preheat inlet air before it enters the combustion chamber 6.

When combustion with the imploding vortex is well established the pressure in the combustion chamber 6 can reach pressure below that of atmospheric pressure. In such case compressor cut-off means may be provided for turning off the compressor 8, and instead opening a choke plate 30 that operates to admit air directly into the air inlet 7 of the combustion chamber 6. Such compressor cut-off means would advantageously include a pressure gauge at the inlet of the combustion chamber 6, actuating means responsive to the pressure gauge coupled to the choke plate 30, and compressor cut-off means also coupled to the pressure gauge for de-energizing the compressor 8.

Fuel in gaseous or vapor form enters the combustion chamber 6 from a fuel inlet 12 in either gaseous or liquid form via a check valve 13 and, in case of liquid fuel, a vaporizer 14 with a heating coil 16 as described in more detail below. The fuel continues through a fuel tube 17, advantageously disposed coaxially within an exhaust tube 18 which provides an exhaust gas escape from the vortex chamber 1. In traversing the fuel tube 17 the fuel becomes even more heated by means of heat transfer from the exhaust tube 18. The fuel enters a fuel ionizing chamber 19 disposed substantially centrally in the vortex chamber 1 wherein the fuel is ionized as described in more detail below, and continues downward through the fuel tube extension 21 to a fuel dispersion unit 22 from which fuel enters the combustion chamber through apertures in the fuel dispersion unit 22 and mixes with the preheated air entering the air inlet 7 as described above. The combustion chamber walls form an inward facing constriction 23 that creates a venturi in the fuel air inlet to the combustion chamber 6. A high voltage electric supply is connected via conductors 26 and 26*a* to the fuel dispersion unit 22 creating electric arcs between the fuel dispersion unit 22 and the constriction 23 which ignite the fuel air mixture in the combustion chamber 6.

A vortex of burning fuel-air mixture is created in the combustion chamber by means of the air being fed tangentially by the air tube 11 from compressor 8 into the cylindrical air space 9, as indicated by arrows A. The rotation of the vortex intensifies as the burning fuel-air mixture expands in the combustion chamber 6, and escapes upward through the upper outlet of the combustion chamber 6, forming an extended outer vortex indicated by arrow C which follows the inner wall surface of the vortex chamber 1 in an upward moving spiral motion.

As the outer vortex C formed of still burning and expanding air-fuel mixture approaches the inward curved upper first end wall 3, the vortex is turned into an inner vortex D that axially changes direction downward while retaining its rotational direction, but at a greatly increased rotational speed due to the reduction of the diameter of the vortex. As the inner vortex reaches the lower second end wall 4 it is forced outward to merge with the outer vortex C, and thereby repeats the entire cycle of rotating gases forming a system of a so-called imploding gas plasma vortex, wherein a very high pressure and temperature condition is created in the region of the outer vortex and relatively low pressure and low temperature but very high speed is created in the region of the inner vortex.

Electric charges are created due to the high rotational speed and resultant gravitational gradient by the plasma in the vortices formed in the vortex chamber 1, and an electric potential differential is formed between the inner structures of the vortex chamber, i.e. the ionizing chamber 19 and the fuel tube 17 and its lower extension 21. Electric insulator 27 is therefore inserted in the fuel tube 17 and fuel tube extension 21, and insulator 29 serves to insulate the electric conductor 26*a*.

The vortex chamber 1 is advantageously provided with a heat-protective lining 34 of graphite, ceramic or other high temperature-resistant material especially at the bottom end wall 4 proximal to the outlet of the combustion chamber 6 where the temperature is especially high. Similarly the upper part of the combustion chamber 6 is provided with a heat protective ring 36 also of a highly heat-resistant material.

An expansion relief valve 25 at the top of the heat transfer medium container 31 serves to relieve excessive pressure in the container 31.

The operation of the invention leads to a high degree of efficiency of the combustion process. The heat generated by the combustion in the vortex chamber is transferred through the walls 2 of the vortex chamber to a heat transfer medium, gaseous or liquid, contained in heat transfer medium container 31 for containing either liquid, e.g. water or gas e.g. air as heat transfer media which is connected via inlet 32 and outlets 33' and 33" to an external heat sink, not shown.

The operation of the invention includes starting the air supply blower 24 so as to start the pattern of vortex rotation. It will be noted that the air enters the system tangentially at the upper and outer air space 9 in air tube 11 causing the air to move in a helical and downward spiral path forming the vortex indicated by arrow 19' at the inlet end 7 of combustion chamber 6, where it enters the venturi 23 of the combustion chamber and causes the air masses in the combustion chamber 6 to move in a substantially upward-moving helical path. The venturi creates a low pressure region. The vortex at this region increases in velocity, creating a high pressure at its periphery and a low pressure at its central core.

Fuel entering the system through the one-way valve 13 and vaporizer 14 enters the ionizing fuel chamber 19 that contains a vapor dispersing plate 20. The fuel next passes into the vapor dispersing unit 22. A high-voltage electric current is passed through conductors 26, 26*a* connected to the fuel dispersing unit causing an electric arc to form between the dispersing unit 22 and the sides of the venturi, causing ignition of air mixture. A very high temperature rise is created within the combusting chamber, in turn forming the very high velocity and high temperature imploding vortex, first in the combustion chamber and next in the vortex chamber serving as a heat collecting chamber. Due to the gravitational field created in both chambers by the imploding vortices the gas masses in these combusting gases become stratified, with the heavier particles seeking the hottest area at the outer perimeter of the vortex. The stratification provides a very long path for these partly burned fuel particles and traps them in the respective strata until they give up their kinetic mass energy, so that they can move to the low pressure region of the vortex center. The flow patterns of this imploding vortex take a shape comparable to that of an inverted tornado, so that the lighter particles and masses will move to the top center of the implosion and down and around the ionizing chamber 19. The ionizing chamber 19 becomes continuously bathed in the free electrons set free by the high velocity vortices created by the imploding combustion. The free electrons drift to the center so they can readily move into the ionizing fuel chamber 19 and attach themselves to the gasified fuel particles that then cause the fuel vapor to behave as a plasma. The center region of the implosion is at relatively low speed and cool temperatures as compared to the conditions at the outer periphery. A test performed on a working system shown several hundreds of degrees F. temperature at its center, as compared to thousands of degrees at its perimeter. The ionizing chamber 19 is therefore located in a safe zone and keeps the fuel temperature at a desired level. Once the system has reached operating temperature, the operation of electric power to the fuel vaporizer 14 can be disconnected since the temperature of the ionizing chamber 19 becomes adequate to completely vaporize the fuel. In a particular embodiment the combustion and vortex chambers (6,1) can be electrically insulated from their bases and the outer wall 31 of the heat transfer medium container. In this version of the invention the combustion and vortex chambers will act as a positive electrode, i.e. anode, and the ionizing chamber 19 will act as a negative electrode i.e. cathode. It is accordingly possible to draw an electric current between the anode and cathode according to the principles of magneto hydrodynamics electricity generation. The magneto-hydrodynamic action can, if desired, be enhanced by introducing water, steam or potassium salts or other agents that operate to enhance the ionization of the gas plasma into the imploding vortex.

Figure 2:
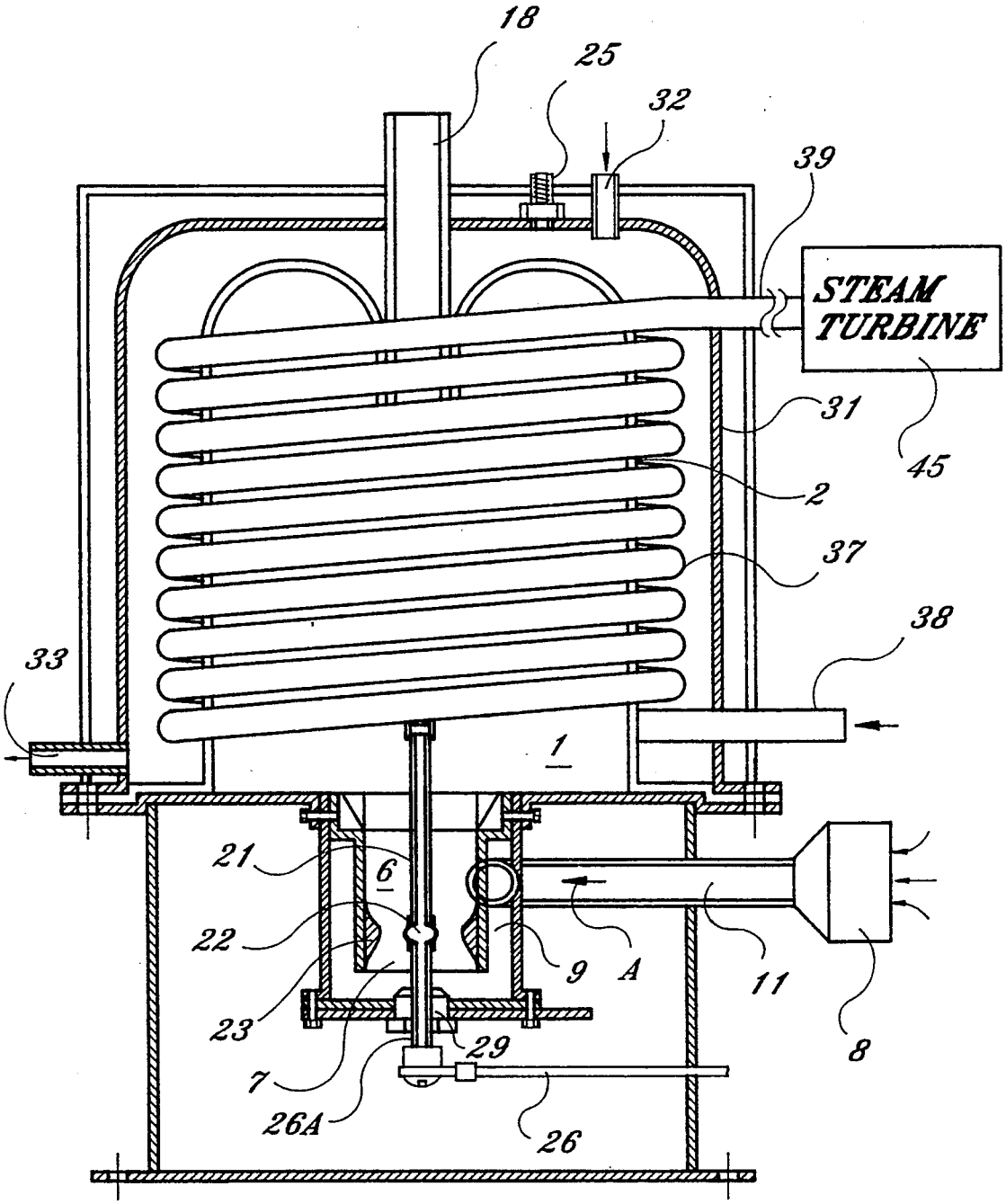
FIG. 2 is a diagrammatic cross-sectional view of the invention showing a heat transfer coil.

FIG. 2 shows another version of the energy converter, having the same basic elements as described above under FIG. 1 and using the same reference numerals for corresponding elements as in FIG. 1, but having a different heat transfer arrangement, composed of a tubular coil 37 of a good heat-conducting material such as copper or aluminum, having an inlet port 38 and an outlet port 39, in thermal contact with the wall 2 of the vortex chamber 1. The coil 37 may, for example, be traversed by a heat transferring liquid such as water or glycol and/or powdered aluminum.

It follows that the construction shown in FIG. 2 is also well suited to operate as a hot steam generator suitable for commercial steam generation or for driving, for example, a steam turbine 45 since the tubular coil 37 can be made of high strength, high temperature steel alloy capable of containing steam at very high pressure and temperature.

It follows that the vortex chamber may also in this case be surrounded by a heat transfer medium container 31, which can be used for transferring heat, especially to a gaseous heat transfer medium, such as air or the like, by means of suitably located respective inlets and outlets 32, 33.

Such a construction is well suited for a residential heater as a source for both steam heated water and heated air.

Figure 3:
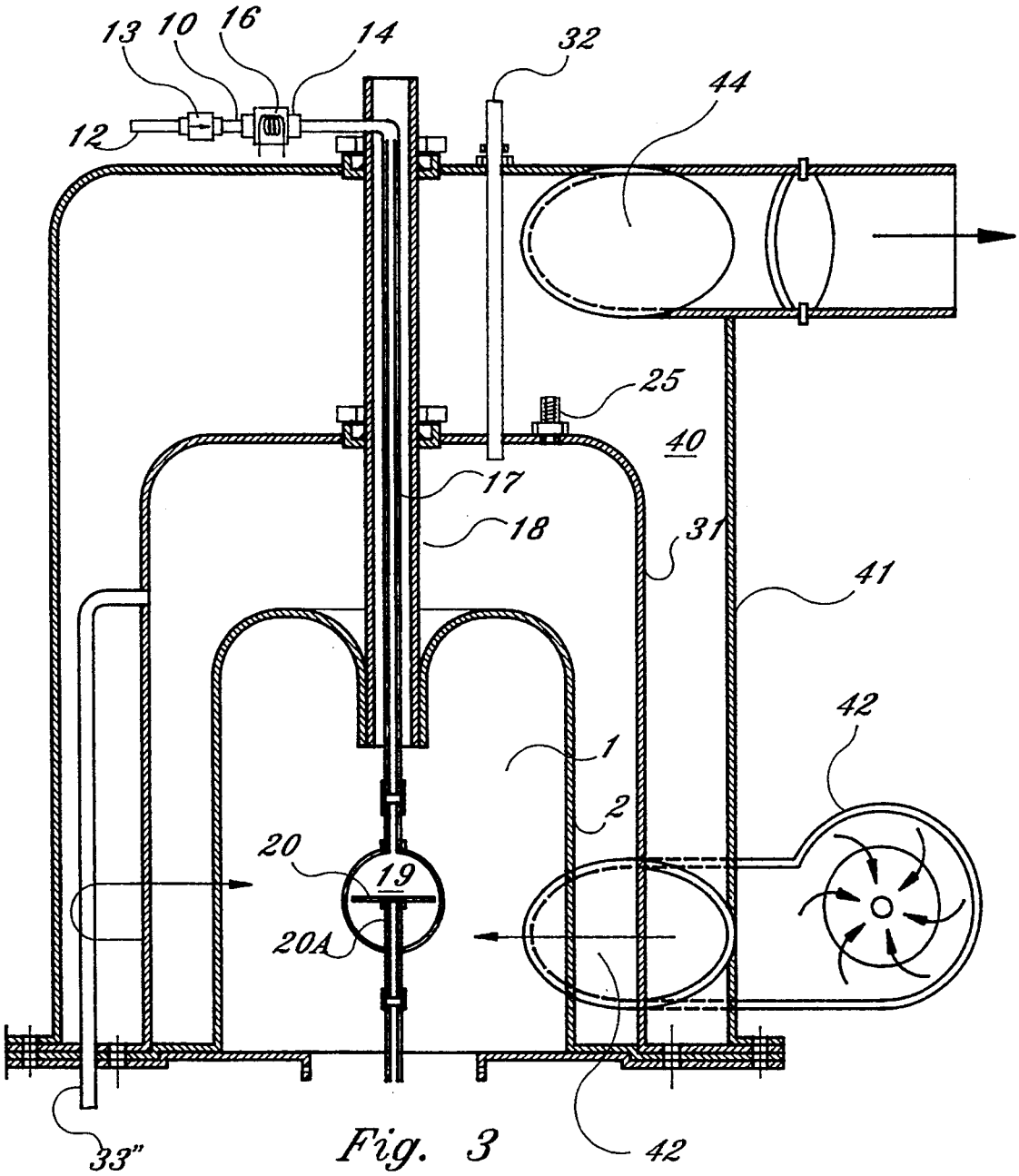
FIG. 3 is an elevational diagrammatic cross-sectional fragmentary view of the invention showing a multimedia heat transfer arrangement.

FIG. 3 shows still another embodiment derived from the embodiment shown in FIG. 1, but not showing the combustion chamber elements since these are similar to those of FIG. 1.

FIG. 3 shows besides the heat transfer medium container 31 as in FIGS. 1 and 2 another heat transfer container 41 enclosing the container 31. The inner heat transfer medium container 31 is constructed for handling a liquid heat transfer medium via respective inlet 32 and outlet 33, while the outer heat transfer medium container 41 is intended for handling gaseous heat transfer medium, e.g. air, driven by a blower 42 in a circular path through the air space 40 between the walls of containers 31 and 41 through an air inlet opening 43 and out through an air outlet opening 44, thereby attaining a very high degree of efficiency of the heat energy transfer.

Figure 4:
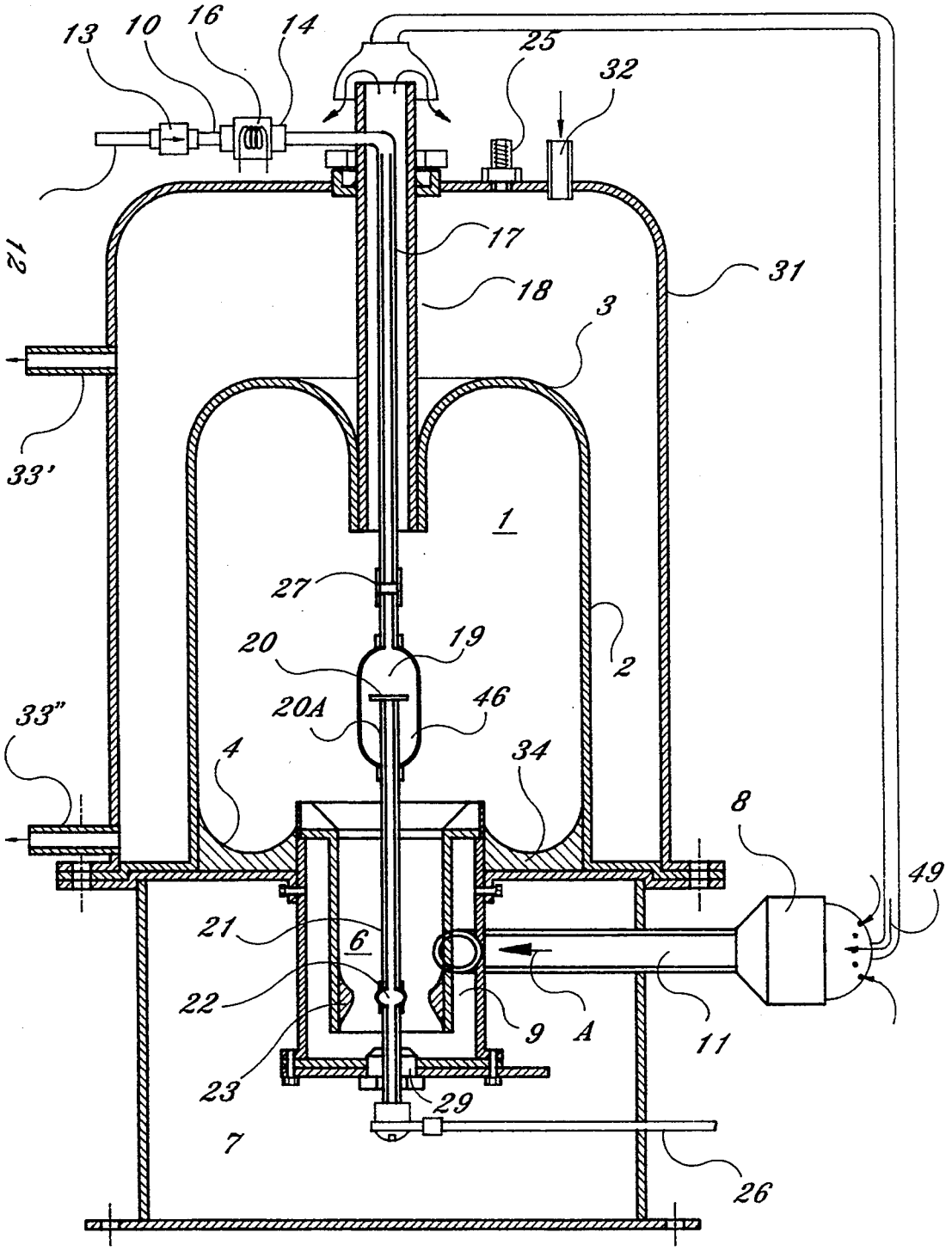
FIG. 4 is an elevational diagrammatic cross-sectional view of the invention showing a version with external exhaust gas return.

FIG. 4 shows an embodiment similar to that of FIG. 1, but is provided with the feature that part of the exhaust gas leaving the exhaust tube 18 is captured by a bell 47 ducted by means of a duct 48 to an input 49 of the air compressor 8, so that part of the exhaust gas is recirculated back into the combustion chamber via compressor 8 which has the advantage that the amount of unburned emissions such as carbohydrates and CO are reduced.

The lower fuel tube extension 21 has a number of weeping holes 46 in the ionizing chamber 19 so that condensed liquid fuel that may accumulate there can escape via the lower fuel tube extension 21.

Figure 5:
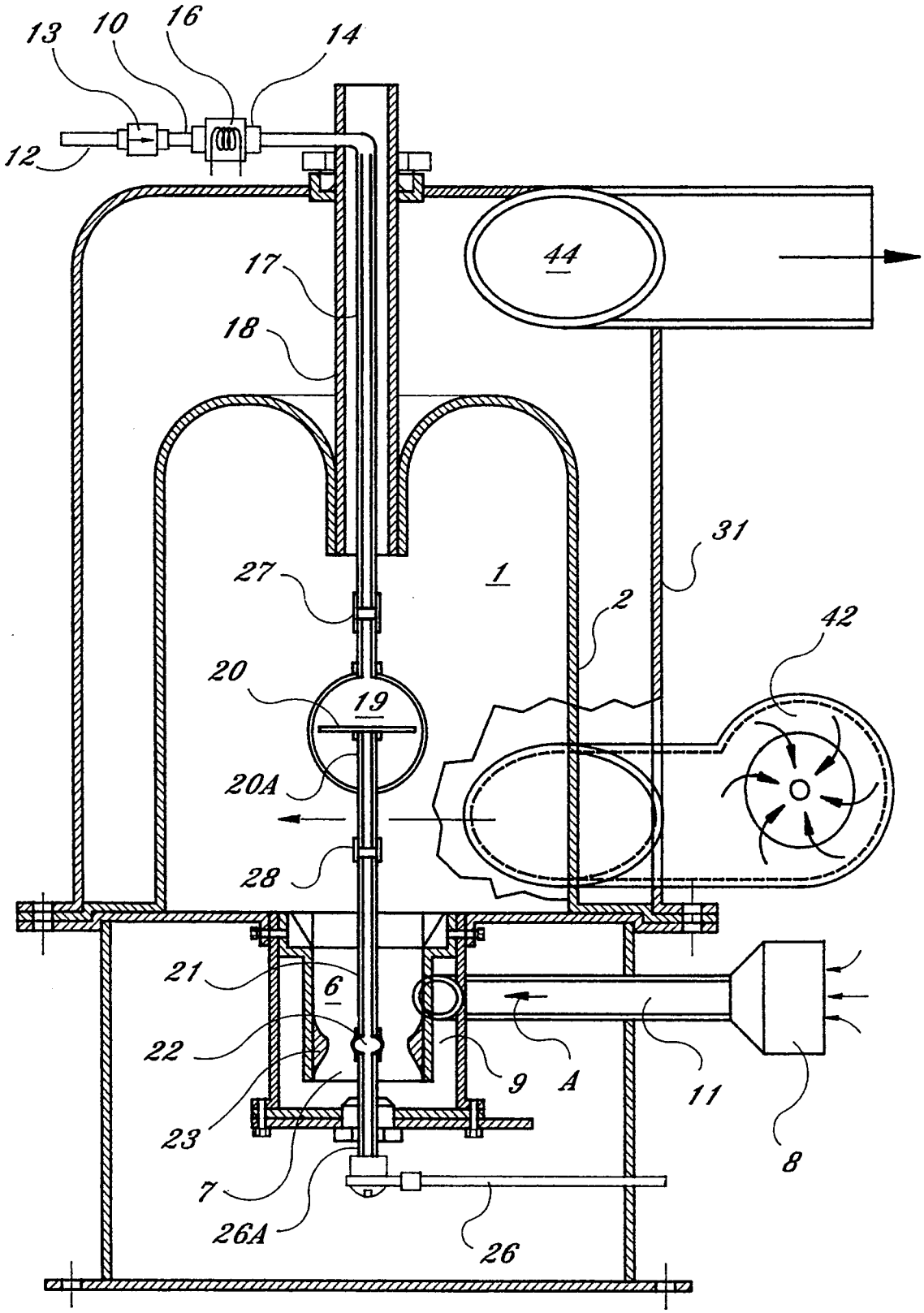
FIG. 5 is an elevational diagrammatic cross-sectional view of the invention showing atmospheric air used for heat transfer medium.

FIG. 5 shows an embodiment similar to that of FIG. 1, again with the same reference numerals for the same elements, but with the outer heat transfer medium container 31 arranged to handle especially a gaseous heat transfer medium, e.g. air, being driven in a long helical path through the container 31 by a blower 42 through an air inlet 43 and out through an air outlet 44. This embodiment is especially well suited for air heating of homes, office buildings, stores, etc., where forced air heating is often the preferred mode of heating.

Figure 6:
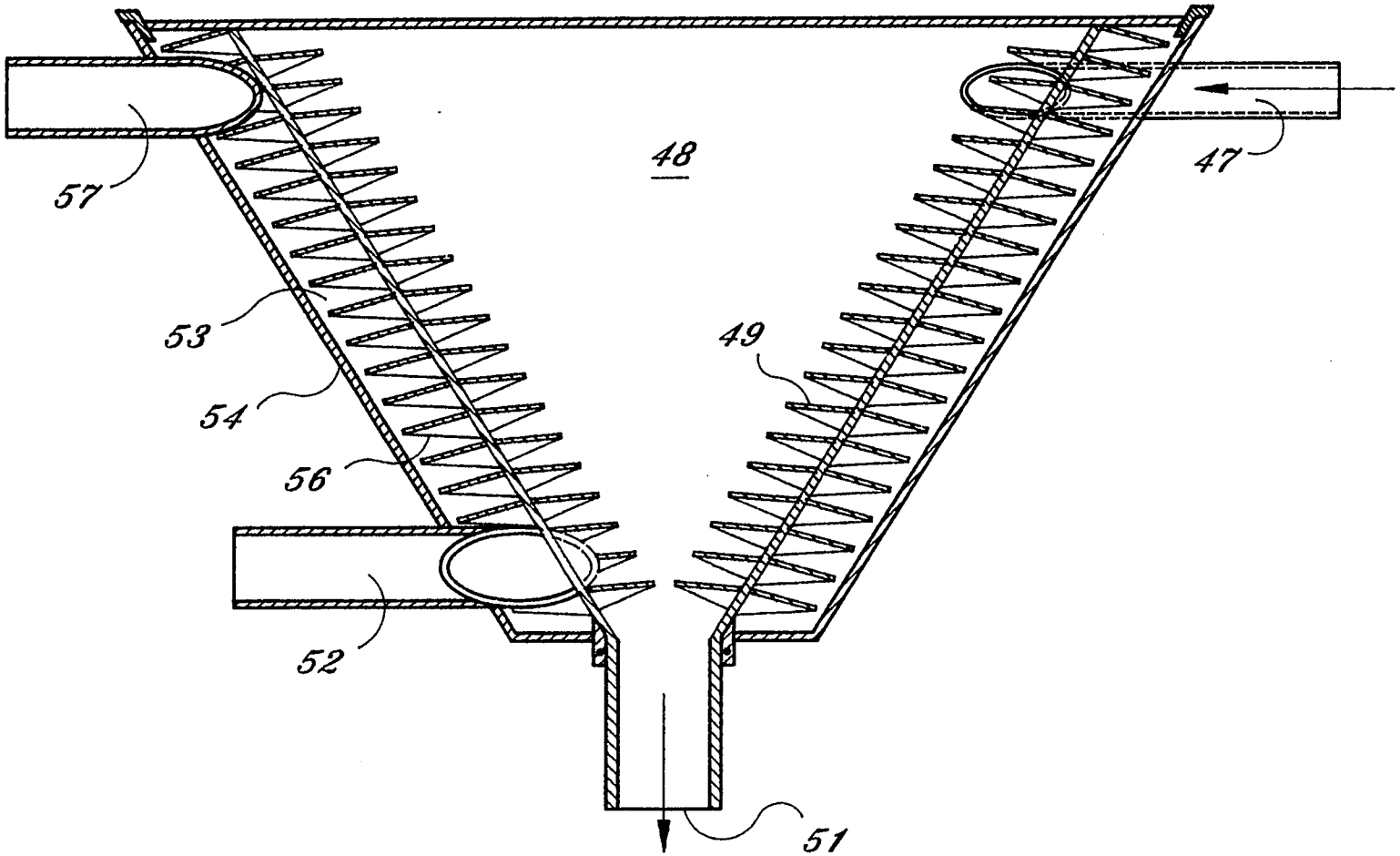
FIG. 6 is an elevational diagrammatic fragmentary view of the invention showing a heat exchanger component.

FIG. 6 shows a heat exchanger that is especially well suited for use in large building complexes such as office buildings and warehouses and the like wherein it is often impractical to distribute the heat transfer medium over large distances by means of heated air since the air ducts required in such places require an unreasonable amount of space. In such cases it is often preferred to distribute the heat by means of a primary liquid heat transfer medium to various heat zones, each equipped with a heat exchanger for transferring heat from the liquid heat transfer medium to a secondary gaseous heat transfer medium, e.g. air, by means of a heat exchanger, of which an especially advantageous construction is shown in FIG. 6.

In FIG. 6 hot liquid heat transfer medium, e.g. water or glycol drawn from outlets 33', 33" in FIGS. 1 and 4 or outlet 33 in FIG. 2, enters as hot liquid at 47 and traverses a funnel-shaped heat transfer chamber 48 having inner walls lined with heat fins 49, cut for example as a spiral attached at one edge to the inside wall of chamber 48, and escapes from the chamber 48 via a liquid outlet 51 to return to the liquid inlet 32 of FIGS. 1 and 4. Gaseous heat transfer medium, e.g. air, is injected at cold air inlet 52 and traverses a funnel-shaped space 53 formed between the inner funnel 48 and an outer funnel 54, wherein the outer surface of the inner funnel 49 is also lined with a spiral-shaped heat transfer fin 56. Heated air escapes at the heated air outlet 57 to heat a given heat zone. For best heat transfer the cold air enters the bottom inlet 52, while the hot liquid enters at the top hot liquid inlet 47.

The heat exchanger according to FIG. 6 is also very well suited for condensing steam of high temperature entering at inlet 47 to water exiting at exit 51, with cooling fluid entering at inlet 52 and exiting at exit 57.

The fuel vaporizer 14 shown in FIG. 1 serves to preheat and vaporize liquid fuel entering at fuel line 12 via a one-way valve 13. Various forms of fuel vaporizers are shown and described in more detail below.

Figure 7:
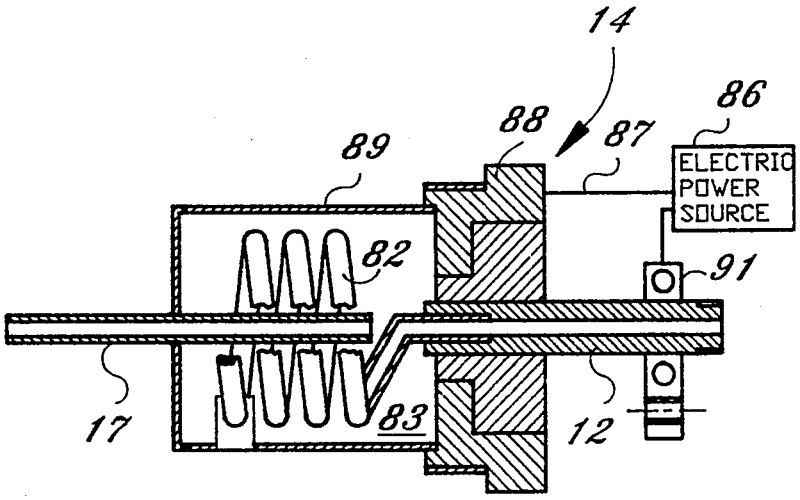
FIG. 7 is an elevational diagrammatic cross-sectional view of the invention showing a fuel vaporizing element.
Figure 8:
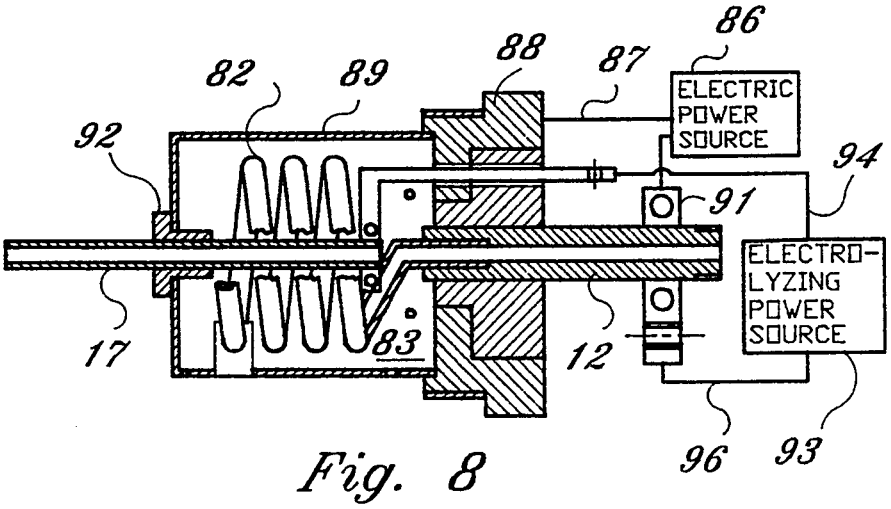
FIG. 8 is an elevational diagrammatic cross-sectional view of the invention showing another fuel vaporizing element.
Figure 9:
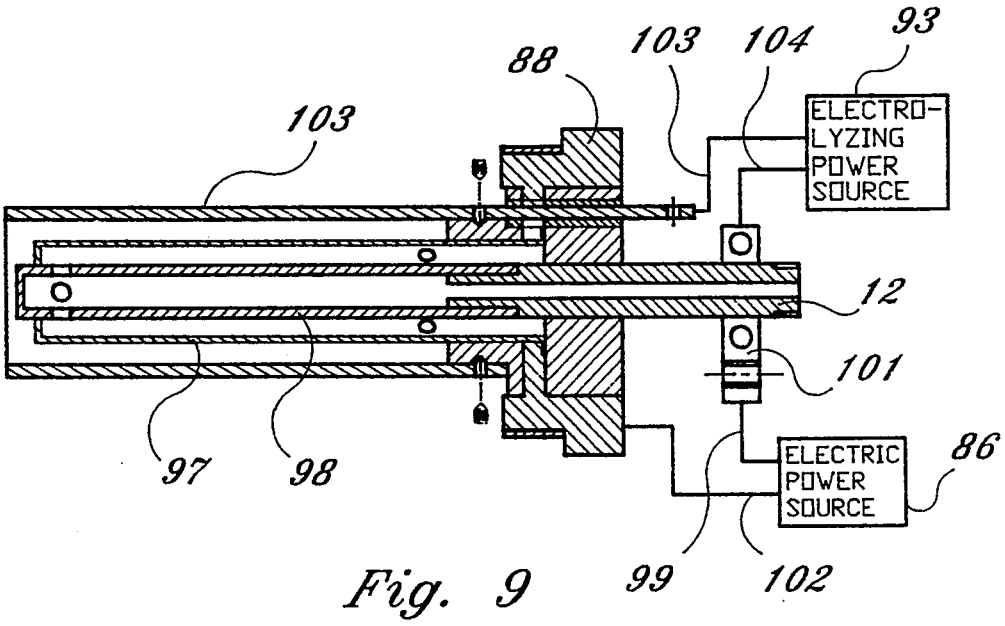
FIG. 9 is an elevational diagrammatic cross-sectional view of the invention showing a third version of a fuel vaporizing element.

FIGS. 7, 8 and 9 show various forms of fuel vaporizers 14 which can be used in all embodiments of the invention to vaporize liquid fuel.

In FIG. 7, liquid fuel entering at fuel pipe 12 traverses a coiled tubular heating element 82, wherein it is vaporized and enters a vapor chamber 83, from where it exits through vapor tube 17. The heating element 82 is heated by current from an electric power source 86, connected thereto via conductor 87, a metallic body 88, the walls 89 of vapor chamber 83 and return path terminal 91.

FIG. 8 shows a vaporizer of similar construction as shown in FIG. 7, but having the vapor tube 17 insulated by an electric insulator 92 from the walls 89 of the vapor chamber 83, and having an electrolyzing power source 93 connected via conductors 94, 96 to the vaporizer for applying an electrolyzing potential to the vapor tube 17, so as to electrolyze fuel vapors issuing from vapor tube 84.

FIG. 9 shows a vaporizer having a heating element composed of series-connected concentric tubular elements 97, 98 made of resistive electric material heated by electric power source 86 via conductor 99, terminal 101, fuel pipe 12, conducting body 88 and return conductor 102. An outer tubular electrolyzing element 103 is connected to an electrolyzing power source 93 via conductor 103. The electrolyzing power source 93 is connected to electric power source 86 via conductor 104, terminal 101 and conductor 99.

Figure 10:
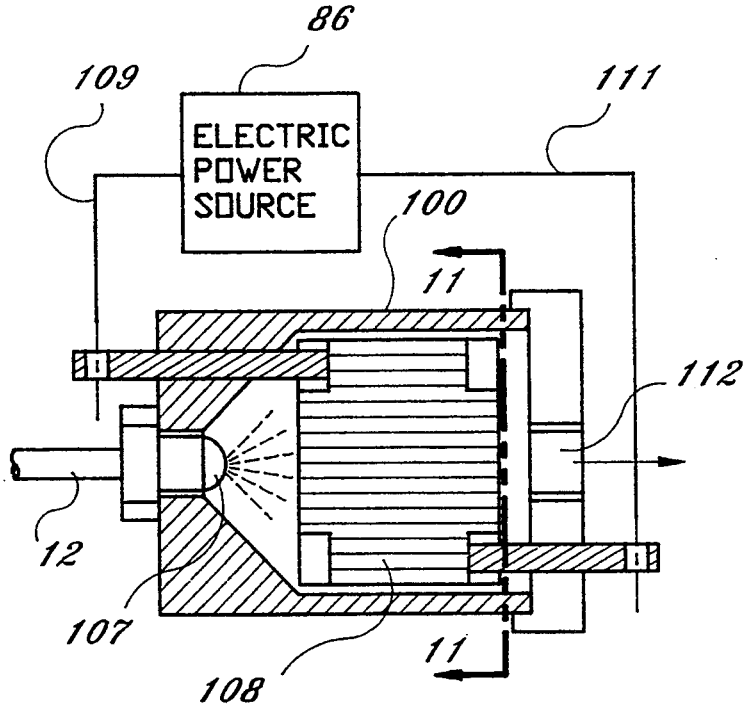
FIG. 10 is an elevational diagrammatic cross-sectional view of the invention showing a fuel vaporizer with a reticulated heating core.
Figure 11:
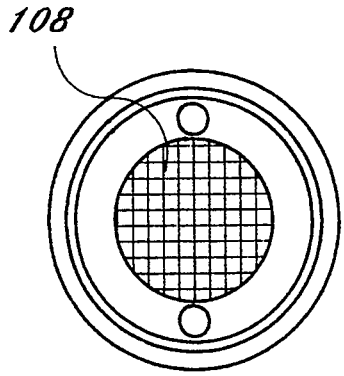
FIG. 11 is an elevational diagrammatic cross-sectional view of the invention seen along the line 11—11 of FIG. 10.

FIGS. 10 and 11 show a fuel vaporizer for vaporizing large fuel flows having a liquid fuel inlet line 12 connected to fuel dispersing spray nozzle 107 which sprays fuel into a reticulated metal heating element 108 having a honey-combed cross-section as shown in FIG. 11, and which is heated by electric current supplied by an electric power source 86 via conductors 109, 111. The fuel is vaporized in heating element 108 and exits at fuel vapor outlet 112. The heating element 108 is supported within an electrically insulating containing structures indicated by reference numeral 100 so as to avoid short-circuiting the heating element.

Figure 12:
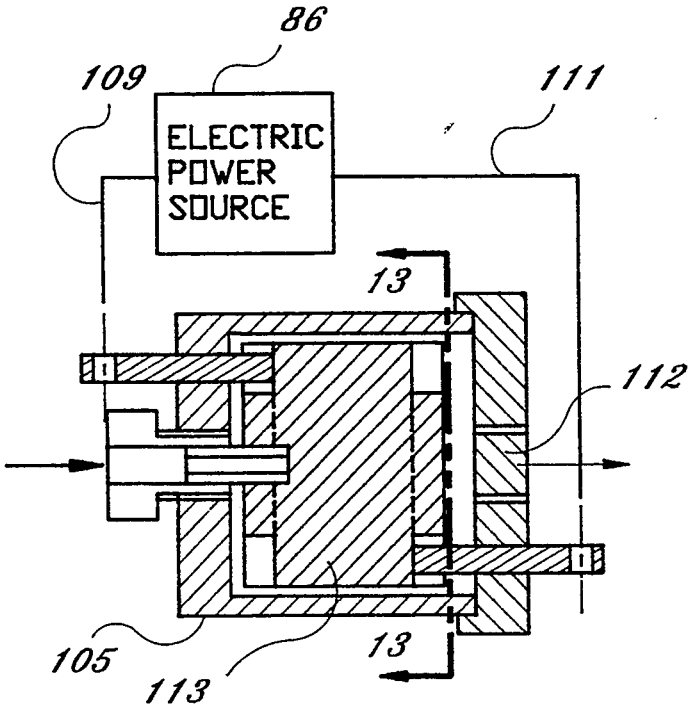
FIG. 12 is a plan diagrammatic cross-sectional view of the invention showing a fuel vaporizer with a porous core.
Figure 13:
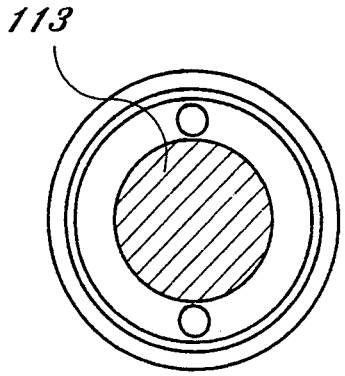
FIG. 13 is a plan cross-sectional view of the invention seen along the line 13—13 of FIG. 12.

FIGS. 12 and 13 show a vaporizer of similar construction as in FIGS. 10 and 4, but having a heating element 113 made of porous metal instead of a honey-combed heating body as in FIG. 10, supported in insulating containing structure 105.

The internal metallic surfaces of the vaporizers shown in FIGS. 7, 8, 9, 10 and 12 may be coated with a catalyzing element, which enhances the catalyzation of the fuel vapors, such as elements platiunum, palladium, nickel or the like.

I claim:

1. A heating system for heating a heat sink via a heat transfer medium, comprising a vortex chamber having opposite first and second inwardly curved end walls, a combustion chamber fluidly communicating with said vortex chamber, fuel-air supply means fluidly communicating with said combustion chamber for injecting fuel-air mixture into said combustion chamber, ignition means in said combustion chamber for igniting said fuel-air mixture, a fuel ionizing chamber disposed in said vortex chamber fluidly communicating with said fuel-air supply means for ionizing fuel entering said fuel-air supply means, and heat transfer medium containing means for holding said heat transfer medium in thermal contact with said vortex chamber.

2. A heating system according to claim 1, including an air preheat space enclosing said combustion chamber, at least one air tube having an air outlet tangentially engaging said air preheat space and an air inlet, and an air blower connected to said air inlet for injecting air into said air preheat space for generating a vortex of preheated air in said air preheat space.

3. A heating system according to claim 2, including a fuel dispersion unit in said combustion chamber, fluidly communicating with said fuel ionizing chamber for dispersing fuel into said combustion chamber.

4. A heating system according to claim 3, including in said fuel-air supply means a fuel source, a fuel vaporizer having a fuel inlet fluidly communicating with said fuel source, and a fuel outlet fluidly communicating with said fuel ionizing chamber.

5. A heating system according to claim 4, including fuel dispersing means in said fuel ionizing chamber.

6. A heating system according to claim 5, including a vapor dispersing plate in said fuel dispersing means, and a pedestal supporting said to provide proper antecedent basis in said fuel ionizing chamber.

7. A heating system according to claim 6, including at least one weeping hole in said pedestal for releasing fuel accumulating in said fuel ionizing chamber.

8. A heating system according to claim 1, including electric insulating means for electrically insulating said fuel ionizing chamber from said vortex chamber.

9. A heating system according to claim 3, including a plurality of apertures in said fuel dispersion unit for passing ionized fuel into said combustion chamber.

10. A heating system according to claim 2, including an exhaust tube fluidly communicating with said vortex chamber for exhausting burnt fuel air mixture.

11. A heating system according to claim 10, including a fuel tube disposed coaxially within said exhaust tube in fluid communication with said fuel vaporizer.

12. A heating system according to claim 11, including a first electric insulator in said fuel tube for electrically insulating said fuel ionizing chamber from said fuel vaporizer.

13. A heating system according to claim 11, including a tubular connection between said fuel ionizing chamber and said fuel dispersion unit.

14. A heating system according to claim 1, including a heat sink in fluid communication with said heat transfer containing means, and wherein said heat transfer medium is a gaseous fluid.

15. A heating system according to claim 1, including a plurality of heat transfer chambers in said heat transfer medium containing means, each of said heat transfer chambers containing a respective heat transfer medium in fluid communication with a respective heat sink.

16. A heating system according to claim 15, including in said plurality of heat transfer chambers at least one primary heat transfer chamber formed as a tubular coil in thermal contact with said vortex chamber.

17. A heating system according to claim 16, including in said plurality of heat transfer chambers a secondary heat chamber enclosing said primary heat chamber.

18. A heating system according to claim 1, including a heat-protective lining in at least part of said vortex chamber.

19. A heating system according to claim 18, including a heat protective lining in at least one of said end walls proximal to said combustion chamber.

20. A heating system according to claim 18, including a heat protective lining in at least part of said combustion chamber.

21. A heating system according to claim 10, including an exhaust outlet of said exhaust tube, and a bell covering said exhaust outlet, an exhaust gas inlet in said air blower and ducting means connecting said bell with said exhaust gas inlet for recirculating part of said burnt fuel air mixture.

22. A heating system according to claim 2, including a venturi in said combustion chamber fluidly communicating with said air inlet, said venturi having a constriction aligned with said fuel dispersion unit.

23. A heating system according to claim 22, including a high voltage power source in said ignition means connected to said fuel dispersion unit for generating ignition sparks between said venturi and said fuel dispersion unit.

24. A heating system according to claim 4, including a permeable heating element in said fuel vaporizer traversed by said fuel, an electric power source connected to said heating element for electrically heating said fuel in said heating element.

25. A heating system according to claim 24 including a coiled tubular element in said permeable heating element traversed by said fuel.

26. A heating system according to claim 24 including a plurality of concentric, series-connected tubular elements in said permeable heating element.

27. A heating system according to claim 24, including an electrolyzing electrode proximal to said permeable heating element, and a high voltage power supply connected with one pole to said heating element and another electrode connected to said electrolyzing electrode for electrolyzing said fuel vapors.

28. A heating system according to claim 24, including a porous metallic element in said heating element traversed by said fuel.

29. A heating system according to claim 24, including a reticulated metallic element in said heating element traversed by said fuel.

30. A heating system according to claim 1, including a heat exchanger disposed between said heating system and said heat sink, said heat exchanger including an inner funnel-shaped body traversed by said heat transfer medium and an outer funnel-shaped body enclosing said inner funnel-shaped body forming a funnel-shaped space between said inner and outer funnel-shaped bodies, and a secondary heat transfer medium traversing said funnel-shaped space.

31. A heating system according to claim 30, including heat transfer fins lining the walls of said inner funnel-shaped body.

32. A heating system according to claim 16, wherein said tubular coil is made of high-temperature, high-strength alloy suitable for generating steam at high pressure, and a steam turbine fluidly communicating with said tubular coil.

33. A heating system according to claim 30, wherein said heat transfer medium in said inner funnel-shaped body is steam to be condensed, and wherein said secondary heat transfer medium is cooling fluid.

* * * * *